United States Patent [19]

Nelson

[11] Patent Number: 4,666,374

[45] Date of Patent: May 19, 1987

[54] METHODS AND APPARATUS FOR PRODUCING UNIFORM DISCHARGE AND SUCTION FLOW RATES

[75] Inventor: Arvid L. Nelson, Quincy, Ill.

[73] Assignee: Cooper Industries, Inc., Houston, Tex.

[21] Appl. No.: 681,581

[22] Filed: Dec. 14, 1984

Related U.S. Application Data

[63] Continuation-in-part of Ser. No. 457,204, Jan. 11, 1983, abandoned.

[51] Int. Cl.[4] ..... F04B 41/06; F15B 13/07

[52] U.S. Cl. ..... 417/3; 91/361; 91/532; 417/46; 417/53; 417/345

[58] Field of Search ..... 417/344, 345, 346, 347, 417/53, 3, 46; 60/484; 91/532, 516, 361, 363 A, 363 R, 3

[56] References Cited

U.S. PATENT DOCUMENTS

| | | | |
|---|---|---|---|
| 3,135,210 | 6/1964 | English | 417/347 |
| 3,847,511 | 11/1974 | Cole | 417/346 X |
| 4,021,156 | 5/1977 | Fuchs et al. | 417/346 |
| 4,106,390 | 8/1978 | Kodaira et al. | 91/42 |
| 4,120,234 | 10/1978 | Joelson | 91/532 X |
| 4,231,441 | 11/1980 | Burckhardt | 91/532 X |
| 4,321,014 | 3/1982 | Eburn, Jr. et al. | 417/5 |
| 4,470,771 | 9/1984 | Hall et al. | 417/346 X |
| 4,490,096 | 12/1984 | Box | 417/344 X |

*Primary Examiner*—Carlton R. Croyle
*Assistant Examiner*—T. Olds
*Attorney, Agent, or Firm*—Finnegan, Henderson, Farabow, Garrett & Dunner

[57] ABSTRACT

A pumping system for producing uniform discharge and suction rates includes a pump connected to a supply of hydraulic fluid to deliver hydraulic control fluid at a selectable flow rate to a proportioning valve. The proportioning valve divides the flow of hydraulic fluid into two resulting flows, each of which is utilized via a four-way valve to drive a piston within a hydraulic cylinder. The positions of the pistons within the cylinders are detected and used to control the proportioning valve such that each piston is imparted with a velocity that varies in a sinusoidal manner in response to the hydraulic fluid delivered to it by the porportioning valve. Sensing of the piston positions and control of the proportioning valve may be accomplished mechanically by a system of cams driven by the pistons, or electronically by a microprocessor receiving signals from transducers coupled to the pistons. The speed of operation of the overall system is adjustable in response to the rate of delivery of hydraulic control fluid from the hydraulic pump.

24 Claims, 19 Drawing Figures

METHODS AND APPARATUS FOR PRODUCING UNIFORM DISCHARGE AND SUCTION FLOW RATES

This application is a continuation-in-part of application Ser. No. 457,204, filed Jan. 11, 1983, now abandoned.

BACKGROUND OF THE INVENTION

The present invention relates to methods and apparatus for producing uniform discharge and suction flow rates and, more particularly, to a hydraulically actuated uniform flow rate pumping system.

Such pumping systems can be used in moving heavy fluids, such as mud which must be removed during oil well drilling operations. Once pumping of a heavy fluid is initiated and a column of fluid is placed in motion by the pumping action, considerable momentum is created by the moving column of fluid. So as to minimize loss of energy, it is therefore desirable to impart a constant or uniform flow rate to the column of fluid, rather than a pulsating flow rate. A uniform flow rate also serves to reduce the occurrence of fatigue in the pipes and lines carrying the moving fluid, as compared with the amount of fatigue which results from the application and absorption of pulsed energy.

Known positive displacement pumps include the use of reciprocating pistons sliding back and forth within cylinders, or plungers sliding back and forth within stuffing boxes, thereby increasing and decreasing a working volume. Check valves control entry into and discharge from the working volume so as to create a pulsating flow by alternate sucking and discharging of the piston or plunger. In order to smooth the pulsating flow, two opposed stuffing boxes having a common piston therebetween have been used so as to produce a double acting pump. Further smoothing of the discharge flow may be accomplished by introducing short-time accumulators in the pipe lines so as to dampen the peaks and fill the valleys that occur during and after the pulsating flow, respectively. Alternately, a number of in-line cylinders each having a piston operated by a common drive may be employed, with each piston being located at a different displaced position within its cylinder relative to the other pistons and their cylinders, so that overlapping of the discharge strokes serves to smooth the total discharge flow.

In known systems employing these foregoing principles, the presence of a number of piston cylinders requires complicated gear reduction mechanisms. Furthermore, known systems for producing a smoothed flow rate utilize linear increases and decreases in the velocity of the pumping pistons, resulting in excessive piston jerk whenever the pistons change direction of movement. This produces fatigue in the piston and associated parts, thereby decreasing the effective life of such pumping systems.

SUMMARY OF THE INVENTION

Accordingly, it is an object of the present invention to produce uniform discharge and suction flow rates allowing a working fluid to be efficiently transported without the energy losses associated with a pulsating flow.

Another object of the present invention is to tailor the individual piston velocity versus time relationships in a pumping system so as to achieve a satisfactory combination of piston velocity, piston acceleration and piston jerk characteristics.

A further object of the present invention is to vary the fluid output of a pumping system by varying delivery flow rate of a hydraulic pump while maintaining stroke length of the hydraulic pistons constant.

Additional objects and advantages of the present invention will be set forth in part in the description which follows and in part will be obvious from that description or may be learned by practice of the invention. The objects and advantages of the invention may be realized and obtained by the methods and apparatus particularly pointed out in the appended claims.

The present invention uses the fact that flow rate directly depends on the sum of pumping piston velocities of all actively discharging pumping cylinders. If the sum of the piston velocities is a constant value, then total discharge flow rate is also constant and no pressure pulsations occur as in crank type reciprocating pumps. Fatigue resulting from piston acceleration and piston jerk may be reduced by controlling the piston velocities so as to smoothly bring the pistons to a halt at their end of stroke.

To achieve the objects and in accordance with the purpose of the invention, as embodied and as broadly described herein, the hydraulically actuated pumping system of the present invention for producing uniform discharge and suction flow rates comprises means for delivering a single flow of hydraulic control fluid; means for selectively proportioning the single flow from the delivery means into a plurality of resultant flows; a plurality of hydraulic cylinders, each cylinder being in fluid communication with a different one of the fluid flows; a plurality of pistons, each piston being sealably fitted in one of the hydraulic cylinders for reciprocating therein in response to a respective different one of the resultant flows; and means for controlling the selectively proportioning means to determine the instantaneous relative magnitude of the resultant flows.

Also, in accordance with the present invention, a method for producing uniform discharge and suction flow rates is provided, the method comprising the steps of delivering a single flow of hydraulic control fluid; selectively proportioning the single flow of hydraulic control fluid into a plurality of resultant flows; complementarily actuating a plurality of pistons by means of the resultant flows, each of the pistons being reciprocatingly fitted into a hydraulic cylinder; and selectively controlling the velocity and displacement of each of the pistons.

The accompanying drawings, which are incorporated in and which constitute a part of this specification, illustrate embodiments of the invention and, together with the description, explain the principles of the invention.

DESCRIPTION OF THE PREFERRED EMBODIMENTS

Reference will now be made in detail to a presently preferred embodiment of the invention, an example of which is illustrated in the accompanying drawings.

Figure 1:
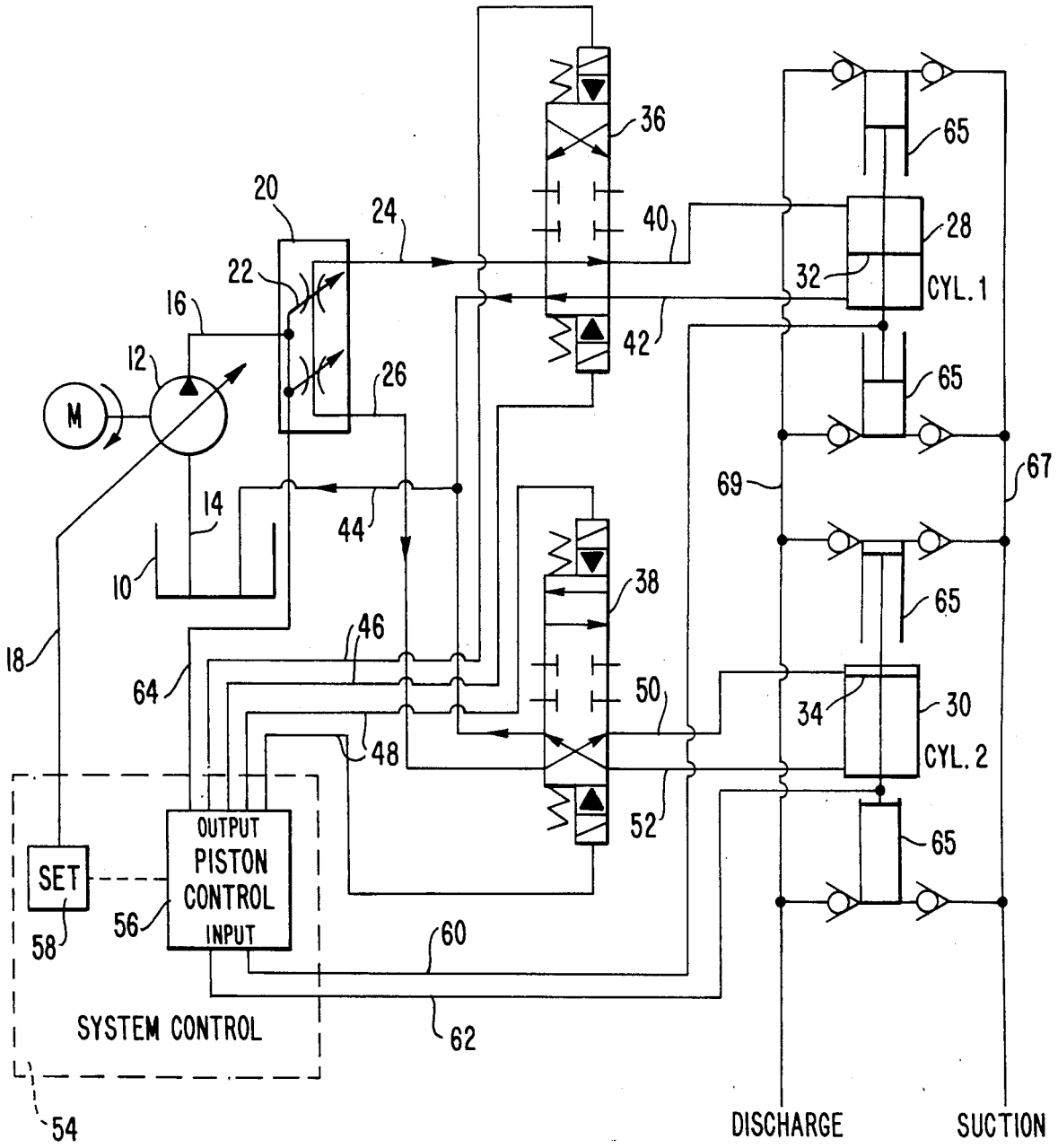
FIG. 1 is a block diagram showing a hydraulically actuated uniform flow rate pumping system in accordance with the present invention.

FIG. 1 is a block diagram of a hydraulically actuated pumping system for producing uniform discharge and suction flow rates. In accordance with the present invention, means are provided for delivering a single flow of hydraulic control fluid. As illustratively embodied herein, the delivering means includes a source of hydraulic fluid 10 and a hydraulic pump 12 which are coupled via a hydraulic line 14. As shown in FIG. 1, hydraulic line 14 is marked with an arrow showing the direction of flow of the hydraulic fluid; in similar fashion, all of the hydraulic lines shown in FIG. 1 except lines 40, 42 and 50, 52 are provided with arrows illustrating the direction of flow of the fluid therethrough and also to distinguish the hydraulic lines from other lines illustrative of functional connections between the elements of the system. Lines 40, 42 and 50, 52 conduct fluid in either direction, depending on the state of reversing valves 36 and 38, respectively.

Hydraulic pump 12 is of a well-known design capable of delivering a constant flow of fluid from hydraulic line 14 to a hydraulic line 16. The rate of delivery of fluid to hydraulic line 16 is adjustable in accordance with a control signal delivered on line 18. The type of control signal generated depends on the type of hydraulic pump 12 used, and may comprise a mechanical valve, an electronic transducer, or the like. Pump 12 may comprise, for example, a variable displacement hydraulic pump such as an Abex/Denison axial piston "series 6" pump having a rocker cam assembly for varying the piston stroke from zero to a maximum with a corresponding variation in pump displacement and delivery. Set control 58 allows manual adjustment of the rocker cam assembly. As explained in further detail hereinbelow, the rate of delivery of fluid from hydraulic pump 12 determines the speed of operation of the pumping system.

In accordance with the present invention, means are also provided for selectively proportioning the single flow from the delivering means into a plurality of resultant flows. As illustratively embodied herein, the proportioning means include a proportioning valve 20 having a movable inner piston 22 which is displaceable to selectively direct the flow of fluid from hydraulic line 16 to either one or both of hydraulic lines 24 and 26. The details of a preferred embodiment of proportioning valve 20 are discussed hereinbelow with reference to FIG. 4. Since the rate of flow of hydraulic fluid through line 16 is constant and is distributed by valve 20 between lines 24 and 26, the sum of the flow rates of the fluids in lines 24 and 26 is likewise constant. This holds true regardless of the specific distribution, at any given moment, of fluid between lines 24 and 26 by valve 20.

In accordance with the present invention, a plurality of hydraulic cylinders are provided, each cylinder being in fluid communication with a different one of the fluid flows, together with a plurality of pistons, each piston being sealably fitted in one of the hydraulic cylinders for reciprocating therein in response to a respective different one of the resultant flows. As illustratively embodied herein, hydraulic cylinders are denoted in FIG. 1 by reference characters 28 and 30, whereas respective pistons are denoted by reference characters 32 and 34. For reference purposes, hydraulic cylinder 28 together with piston 30 are labeled "Cylinder 1", while hydraulic cylinder 30 together with piston 34 are labeled "Cylinder 2". Cylinders 1 and 2 are of the well-known double acting type in which the pistons thereof are provided with rods extending in opposite directions from the ends of the hydraulic cylinder, with the outer ends of the rods capable of being coupled to drive further apparatus.

In order to transmit the hydraulic fluid from the resultant flows, such as the flows in lines 24 and 26, to a plurality of cylinders, such as Cylinders 1 and 2, the present invention further includes means for complementarily changing the direction of movement of the pistons, the direction-changing means being in fluid communication with the selectively proportioning means and the hydraulic cylinders. As illustratively embodied herein, the direction-changing means include solenoid-operated four-way valves 36 and 38. Valves 36 and 38 are of a well-known design capable of controlling the flow of fluid from an inlet line to a number of outlet lines in response to electrical control signals supplied on lines 46 and 48. As shown in FIG. 1, valves 36 and 38 have a center "off" position which blocks all flow through the valve.

Referring first to valve 36, hydraulic fluid from line 24 is selectively distributed to either one of hydraulic lines 40 and 42, both of which are capable of carrying fluid in a forward direction towards Cylinder 1 and in a reverse direction away from Cylinder 1. Valve 36 is also capable of directing fluid returning on either one of lines 40 and 42 to a common return line 44 which is connected back to supply 10. In accordance with its known operation, valve 36 is operated via a control line 46 such that, in a first setting (opposite to that shown in FIG. 1), fluid is directed from line 24 through line 42 in a forward direction into hydraulic Cylinder 1, causing piston 32 to be displaced towards the top end of Cyinder 1 as it is illustrated in FIG. 1. Simultaneously, valve 36 directs the hydraulic fluid returning from Cylinder 1 on line 40 so as to flow through common return line 44 back to supply 10. In response to a command on control line 46, valve 36 shifts to the position shown in FIG. 1 so as to direct hydraulic fluid on line 24 to line 40 in a forward direction towards Cylinder 1 while allowing fluid returning on line 42 to be directed to common return line 44, thus driving piston 32 towards the lower end of Cylinder 1. The command on control line 46 causing this shift in direction is normally instituted once piston 32 has reached either end of Cylinder 1 such that a change in direction of piston movement is necessary. The position of the piston may be sensed, for example, by a switch set to be actuated when the piston reaches the limit of its travel. The piston may also be coupled to a shaft encoder having optical transducer means for feeding piston position signals to control 56. In like fashion, valve 38 responds to a command on control line 48 to appropriately direct fluid between line 26 and lines 50, 52 and 44 so as to produce reciprocating movement of piston 34 within hydraulic cylinder 30.

As can be appreciated from the foregoing, hydraulic fluid flows in the system from supply 10 through hydraulic pump 12, proportioning valve 20, four-way valves 36 and 38, and Cylinders 1 and 2, whereafter it is returned to supply 10 via common return line 44. Thus, the pumping system presents a closed path of flow for the hydraulic fluid contained therein.

In accordance with the present inventioh, means are provided for controlling the selectively proportioning means to determine the instantaneous relative magnitude of the resultant flows. As illustratively shown in FIG. 1, one example of a suitable controlling means is represented by system control 54. As embodied herein, system control 54 may comprise an arrangement of mechanical cams, as further described hereinbelow with respect to FIGS. 5 and 6; in a further embodiment, system control 54 may include a microprocessor, as described in further detail hereinbelow with respect to FIG. 7. For purposes of understanding the present invention as illustrated by the blocx diagram of FIG. 1, system control 54 includes a piston control 56 and a manually actuable control 58 labeled "SET".

SET control 58, according to the embodiment shown in FIG. 1, is coupled to line 18 leading to hydraulic pump 12. As discussed above, SET control 58 enables control of the flow rate of the hydraulic fluid pumped by hydraulic pump 12 and, thus, may be any one of several well-known control means ranging from manually operable valves to electronically controlled devices.

Piston control 56 is coupled via lines 60 and 62 to pistons 32 and 34, respectively, of Cylinders 1 and 2. Information is delivered to piston control 56, via lines 60 and 62, regarding the position of pistons 32 and 34 within hydraulic cylinders 28 and 30, respectively. In response to this piston position information, piston control 56 effects control over (a) proportioning valve 20 via lines 64, (b) four-way valve 36 via lines 46 and (c) four-way valve 38 via line 48. Through these connections, piston control 56 causes proportioning of the resultant flows by proportioning valve 20 and switching of direction of Cylinders 1 and 2 by transferring four-way valves 36 and 38 between their flowreversing states. All of these controls are accomplished in response to detecting the positions of piston 32 and 34 of Cylinders 1 and 2. In addition, means are provided for sensing when pistons 32 and 34 are in or near their center-of-stroke position. As will be explained subsequently, sensing of the center-of-stroke piston position allows more positive control over the reversing operation of the opposite piston. The operation of piston control 56 will now be explained in detail in connection with a discussion of the operation of the pumping system as shown in FIG. 1.

The pumping system illustratively shown in FIG. 1 effects controlled movement of pistons 32 and 34 of Cylinders 1 and 2. To interface this controlled movement so as to enable movement of fluids and the like, a plurality of single acting pumping cylinders 65 are coupled to pistons 32 and 34. Pumping cylinders 65 are of a well-known design capable of translating movement of pistons 32 and 34 into an increasing and decreasing working volume so as to move a fluid. The increasing working volume produced in one of the pumping cylinders 65 associated with piston 32 is coupled through a check valve to a suction line 67 while the decreasing working volume of the opposite cylinder 65 is coupled through a check valve to a discharge line 69 in a conventional manner. All of the cylinders 65 are coupled to common suction and discharge lines. In view of their being known in the art, pumping cylinders 65 are only generally designated as functional elements in the block diagram of FIG. 1 and need not be described in any further detail.

Broadly, operation of a pumping system of the type shown in FIG. 1 involves adjusting hydraulic pump 12 via SET control 58 to create a constant flow of hydraulic fluid from source 10 through lines 14 and 16. The hydraulic fluid from line 16 is selectively proportioned and directed into lines 24 and 26 via proportioning valve 20, so as to drive pistons 32 and 34 of Cylinders 1 and 2, respectively, via four-way valves 36 and 38. The hydraulic fluid displaced by movement of Cylinders 1 and 2 returns through the corresponding four-way valve and is fed back to source 10 via common return line 44. In a manner described in further detail hereinbelow, movement of pistons 32 and 34 is detected and utilized by piston control 56 to effect changes in proportioning valve and four-way valves 36 and 38, which in turn control the movement of pistons 32 and 34. The speed of operation of the entire system is controlled in accordance with the rate at which hydraulic fluid is delivered by pump 12. Thus, by adjusting the rate of hydraulic pump 12, the pumping rate of the system shown in FIG. 1 will likewise be adjusted.

As set forth above, objects of the present invention include minimizing piston acceleration and jerk while maintaining the sum of piston velocities constant to provide a smooth discharge and suction flow. The position, velocity, acceleration and jerk of either one of pistons 32 and 34 may be expressed in terms of time, t, by the following equations:

| | |
|---|---|
| Position | $\int V dt$ |
| Velocity | $V$ |
| Acceleration | $dV/dt$ |
| Jerk | $d^2V/dt^2$ |

Since the motion of pistons 32 and 34 within cylinders 28 and 30, respectively, is a reciprocating one, the instantaneous position of the piston may be expressed in terms of theta, $\theta$, in which movement of the piston from one end of its cylinder to the other (a one-half cycle) corresponds to $\theta=0$ to 180 degrees and movement from one end to the other and back equals 360 degrees. Expressing piston movement in terms of $\theta$, therefore, results in the following:

| | |
|---|---|
| Position | $\int V d\theta$ |
| Velocity | $V$ |
| Acceleration | $dV/d\theta$ |
| Jerk | $d^2V/d\theta^2$ |

The sum of the velocities of the piston of Cylinders 1 and 2 is a constant, K, which is determined by the rate of flow of hydraulic fluid controlled by hydraulic pump 12:

$$V_1+V_2=K$$

This relation may be expressed in terms of $\theta$, as follows:

$$K\ [\sin^2\theta+\cos^2\theta[=K$$

Presuming the velocity of the piston of Cylinder 1 to be $\text{Sin}^2\theta$, its characteristics can be expressed as follows:

| | |
|---|---|
| Position | $\theta/2 - (\sin\theta \cdot \cos\theta)/2$ |
| Velocity | $\sin^2\theta$ |
| Acceleration | $2\sin 2\theta$ |
| Jerk | $-2\cos 2\theta$ |

Figure 2:
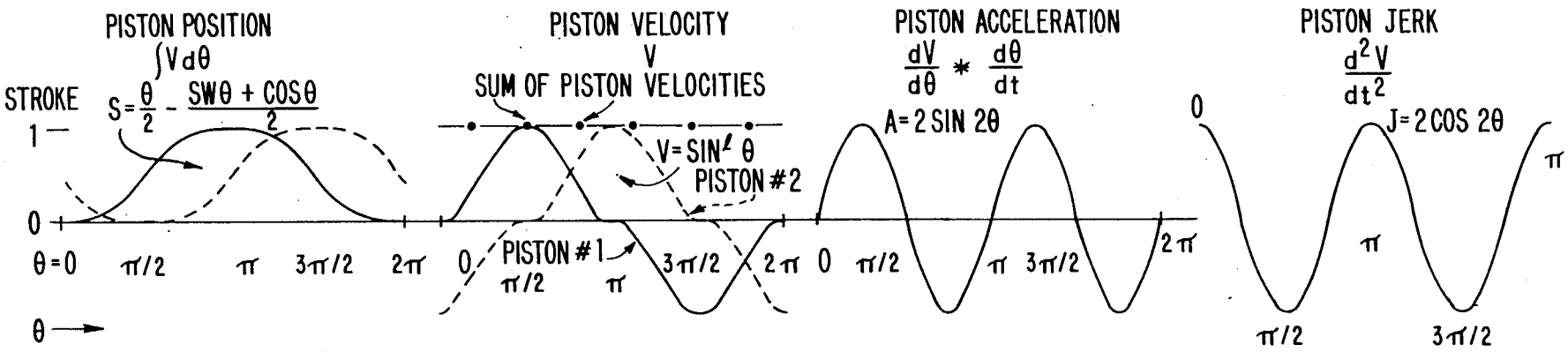
FIG. 2 graphically shows the position, velocity, acceleration and jerk characteristics versus time of the pistons of the system shown in FIG. 1.

These characteristics are graphically depicted in FIG. 2. Since the velocity of the piston of Cylinder 2 is therefore $\cos^2\theta$, its velocity characteristics mirror those of the piston of Cylinder 1 although lagging by 90 degrees. The position and velocity of the piston of Cylinder 2 is depicted in FIG. 2 by the broken lines. Its acceleration and jerk characteristics also mirror those of the piston of Cylinder 1, although neither is shown in FIG. 2 for sake of simplicity.

It may be appreciated from the foregoing description and the graphs of FIG. 2 that the objects of the invention are accomplished by the following characterictics. First, the sum of piston velocities is constant, as shown by the dot-dash line in sum velocity graph of FIG. 2. Second, acceleration and jerk are both reduced and smoothed, which serve to decrease fatigue in the system's parts. This result follows from controlling the piston velocity such that the graphical line corresponding thereto includes curved sections tangential to the maximum positive, zero and maximum negative velocity ordinates into any straight line sections of the plot. This desired relationship holds true regardless of whether the graph plots piston velocity versus $\theta$ or piston velocity versus time, since time and $\theta$ are essentially equivalent for these purposes.

In order to obtain the piston operating characteristics discussed above and graphically shown in FIG. 2, proportioning valve 20 is controlled such that the hydraulic fluid directed to Cylinders 1 and 2 results in the desired movement. For example, at $\pi/2$ the piston of Cylinder 1 is at its maximum velocity whereas the piston of Cylinder 2 is at rest. In the system illustrated in FIG. 1, this corresponds to operation of proportioning valve 20 such that all of the hydraulic fluid from line 16 is directed via line 24 to Cylinder 1, and none is directed via line 26 to Cylinder 2. At position $\pi$, as shown in FIG. 2, the situation is reversed such that the piston of Cylinder 1 is at rest and receives no hydraulic fluid, whereas the piston of Cylinder 2 is at maximum velocity and receives all of the hydraulic fluid. For positions between $\pi/2$ and $\pi$, proportioning valve 20 is adjusted so as to continuously change the proportions of hydraulic fluid distributed between line 24 and line 26. In like fashion, proportioning valve 20 is controlled so as to develop all of the piston velocity characteristics graphically shown in FIG. 2 between 0 and $2\pi$, corresponding to a full cycle of the pump.

FIG. 3 illustrates the positional relationships between proportioning valve 20, Cylinders 1 and 2, and four-way valves 36 and 38 for one complete stroke cycle of the pumping system according to the present invention, in which the same reference characters are used to denote the same elements as illustrated in FIG. 1. As shown in FIG. 3*a*, which corresponds to $\theta=0$ of FIG. 2, the piston 22 of proportioning valve 20 is positioned such that all of the hydraulic fluid from line 16 is delivered to line 26 which is connected to Cylinder 2 through four-way valve 38. Thus, referring to both FIGS. 2 and 3*a*, the piston of Cylinder 2 is at 0.5 stroke position and is operating at maximum negative velocity, whereas the piston of Cylinder 1 is at 0 stroke position and has no velocity. Valve 36 has just been switched to its maximum right-hand position. In FIG. 3*b*, corresponding to $\pi/4$, the proportioning valve is positioned so as to result in an equal flow of hydraulic fluid in lines 24 and 26; this corresponds to the piston of Cylinder 2 having a smaller negative velocity and being at 0.091 stroke and the piston of Cylinder 1 having an increased positive velocity and being at 0.091 stroke as well. FIGS. 3*c*–3*h* set forth the proportioning valve and piston action as $\theta$ increases from $\pi/4$ through $2\pi$.

Figure 3A:
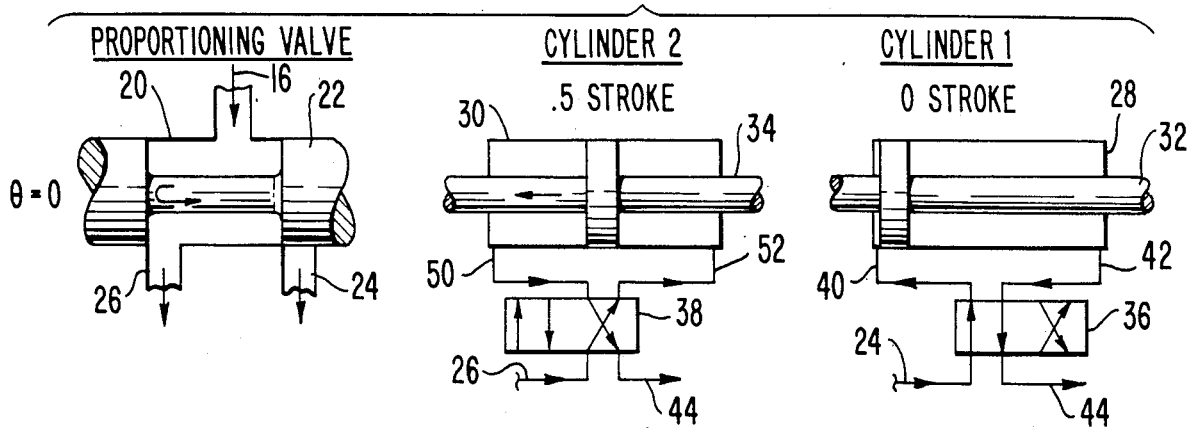
FIGS. 3*a*–3*h* show the relation between the proportioning valve, piston cylinders and control valves of the system of FIG. 1 for one-half of a pumping cycle.
Figure 3B:
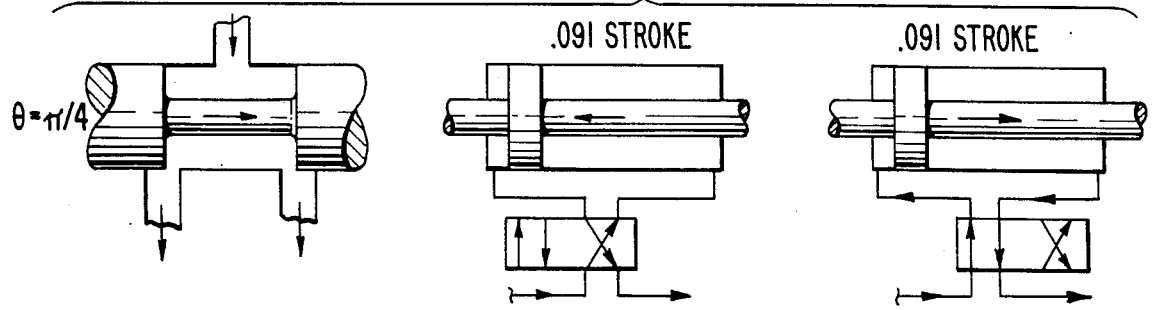
Figure 3C:
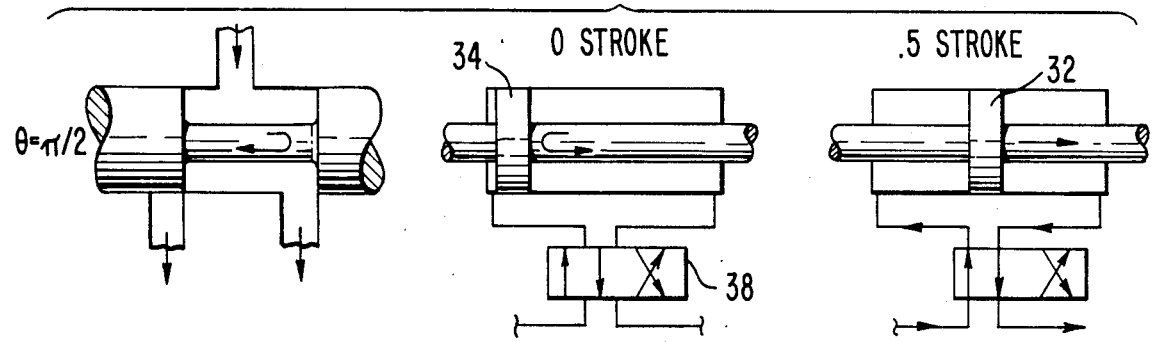
Figure 3D:
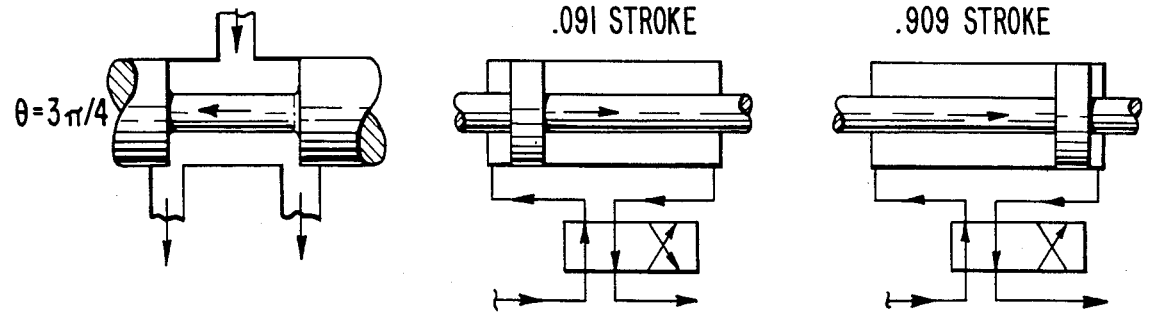
Figure 3E:
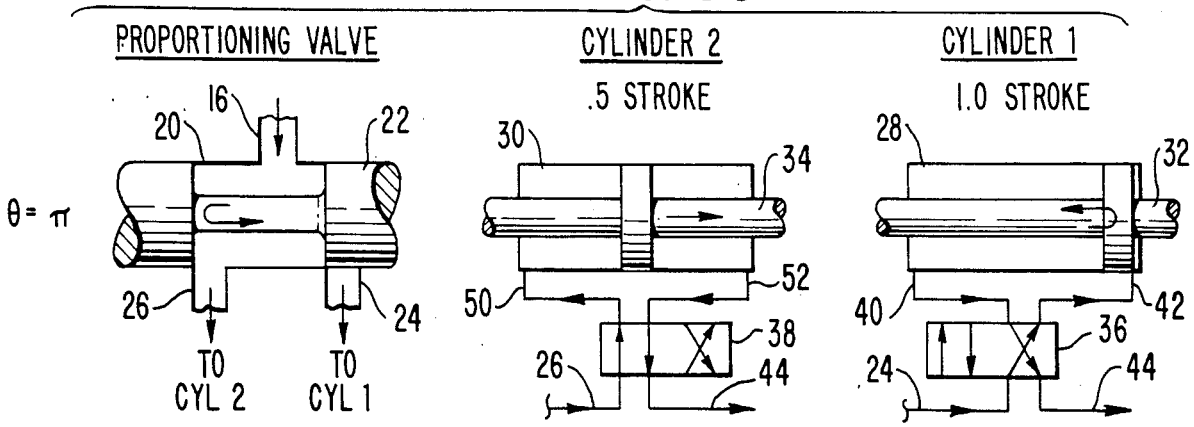
Figure 3F:
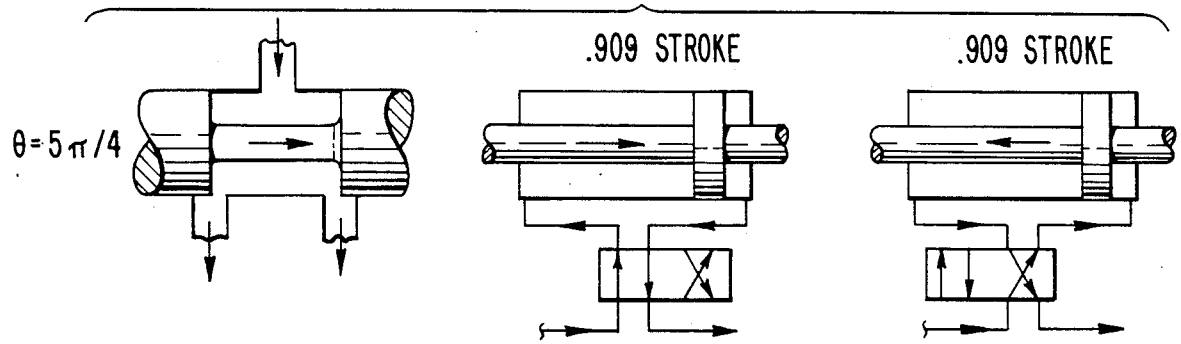
Figure 3G:
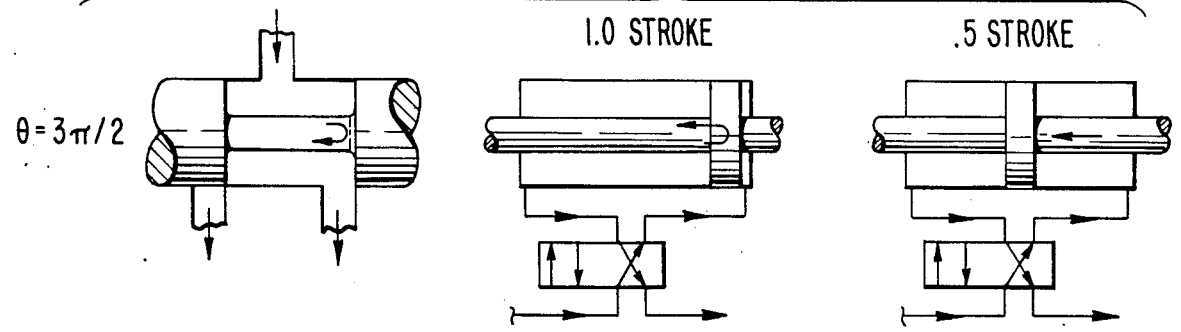
Figure 3H:
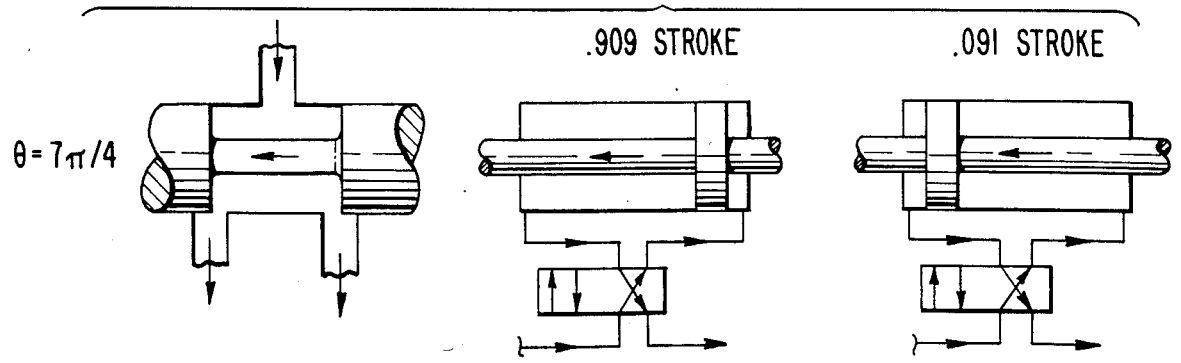

When piston 34 reaches its far left position in FIG. 3*c*, piston control 56 moves valve 38 to a blocking position corresponding to the center "off" position of the valve shown in FIG. 1 and holds it there so that zero piston velocity is maintained. Thereafter, when piston control 56 senses that piston 32 has reached a predetermined point near its center position, valve 38 is transferred to its far right position (shown in FIG. 3*d*) to begin the supply of fluid to piston 34 to move it to the right. Valve 36 is controlled in a corresponding manner each time piston 32 reaches its end of stroke position. Thus, valves 36 and 38 are operated through the reversing cycle by piston control 56 in two stages. In the first stage, the valve is moved to the center blocking position when the piston associated with the valve reaches the end of its stroke. In the second stage, the valve is moved to the reverse flow position when the opposite piston reaches a predetermined joint near center. The exact "near center" point is determined empirically and may be different depending on the direction the piston is travelling. This two-stage more of valve control more accurately maintains the positional relationship of the two pistons and facilitates rapid attainment of desired relative piston positions at pump startup when piston positions may not be at the desired relative locations.

Figure 4:
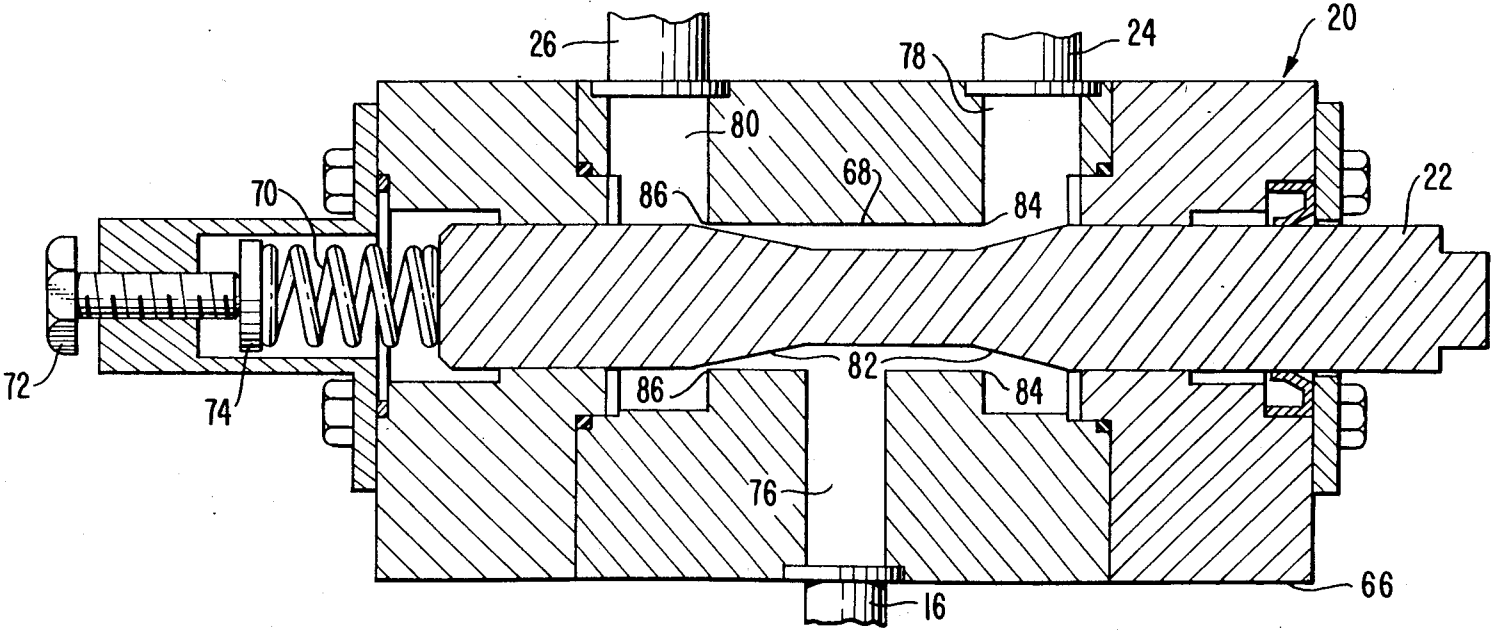
FIG. 4 is a cross-sectional view of the proportioning valve of the system shown in FIG. 1.

Details of a preferred embodiment of proportioning valve 20 are shown in cross-sectional view in FIG. 4. Valve 20 includes a housing 66 having a central passageway 68 provided therein. Positioned coaxially in passageway 68 is valve member 22 displaceable against the bias of a spring 70 located at one end of housing 66. The degree of tension exerted by spring 70 against valve member 22 may be adjusted by means of a screw 72 having a plurality of external threads corresponding to a plurality of internal threads provided in the end of housing 66. Screw 72 is directed against a compression plate 74 which engages spring 70 to adjust the tenson thereof. Housing 66 and valve member 22 may be constructed of any of a variety of well-known materials capable of withstanding the pressures exerted by hydraulic fluids in a closed hydraulic system, including metals such as steel and aluminum, or a suitable plastics material.

Passageways 76, 78 and 80 are provided through the wall of housing 66 and in communication with each other via central bore 68 Passageways 76, 78 and 80 are connected to lines 16, 24 any 26, respectively, by any one of numerous means well-known in the art which permit secure, leak-free connection between hydraulic lines and valves. In order to selectively direct fluid entering passageway 76 in a desired proportion between passageways 78 and 80, valve member 22 is provided with a pair of outwardly-diverging opposing frustoconical portions 82. The surface of portions 82 cooperates with a pair of inner shoulders 84 and 86 so as to sealingly engage therewith. Thus, by displaying valve member 22 to the left or right from the position shown in FIG. 4, the interaction between frustoconical portions 82 and shoulder portions 84 and 86 may be continuously adjusted to produce various proportions of flow in passageways 78 and 80.

Figure 5:
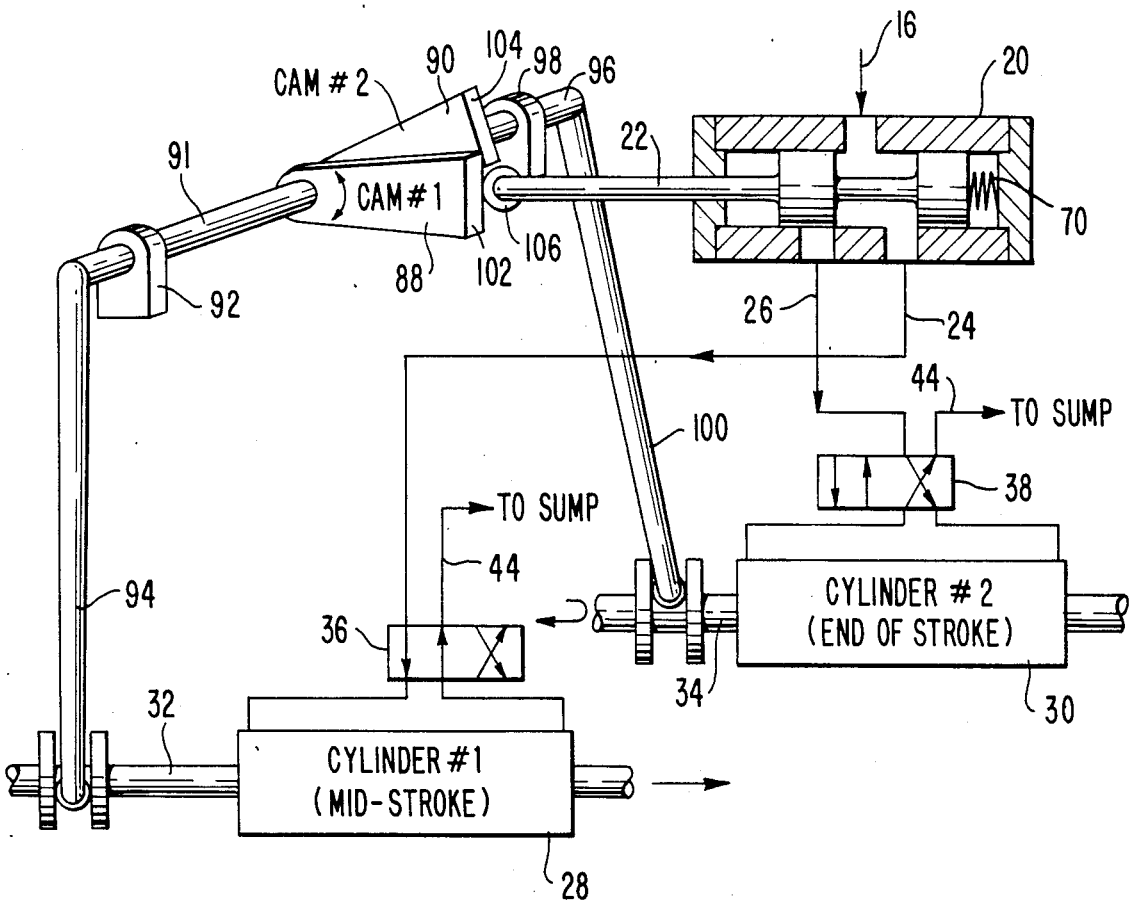
FIG. 5 shows a first embodiment of the system control of the pumping system of FIG. 1.

FIG. 5 illustrates an embodiment of piston control 56 utilizing a pair of cams 88 and 90 mechanically coupled to pistons 32 and 34, respectively. Cam 88 is fixedly secured to a lateral arm 91 rotatable within a support 92. Lateral arm 91 is fixedly coupled to a longitudinal arm 94 which is pivotally coupled to piston 32 of Cylinder 1. Thus, as piston 32 reciprocates within the cylinder housing 28, the reciprocating movement is translated to cause cam 88 to likewise move in a oscillating reciprocating manner, as indicated by the arrows therein as shown in FIG. 5. In like fashion, cam 90 is coupled to piston 34 by a lateral arm 96 rotatable within a support 98 and connected to longitudinal arm 100 which is pivotally coupled to piston 34. Thus, cam 96 moves in a oscillating fashion similar to that of cam 88, in response to movement of piston 34.

Cams 88 and 90 are provided with contoured surfaces 102 and 104 which arm in contact with a cam follower 106 attached to the extending end of valve member 22 of proportioning valve 20. The action of spring 70 urges valve member 22 towards the left, as shown in FIG. 5, so that cam follower 106 is maintained constantly in contact with either one or both of cam surfaces 102 and 104. To accomplish this, cams 88 and 90 are positioned sufficiently proximite one another so that cam follower 106 can be in contact with and controlled by both cam surfaces 102 and 104. According to a preferred embodiment, cam follower 106 may comprise a rubber wheel coupled to the extending end of valve member 22 and rotatable thereon.

FIG. 6 illustrates the positioning relationships between cam surfaces 102 and 104, and cam follower 106 for movement of pistons 32 and 34 through a partial stroke cycle. As seen from the drawings in FIGS. 6*a* through *f*, cam follower 106 traces the forward-most extending one of cam surfaces 102 and 104. Special note is made of FIG. 6*d* 10 corresponding to the piston of Cylinder 1 being at 0.5 stroke and the piston of Cylinder 2 being at 0 stroke position. In this case, the lower end of cam surface 104 is abbreviated so as to no longer contact cam follower 106. If not abbreviated in this matter, the system would beoome locked in this position since the return force of spring 70 would be negated by the presence of surface 104 as shown in FIG. 6; however the system can continue to operate smoothly and continuously. In like fashion, the upper end of cam surface 104, corresponding to 1.0 stroke, must also be abbreviated since the same problem is encountered at that stroke position. In other words, the cam connected to the piston, which is at its extreme end position when the proportioning valve spool is at the far end of its travel, is truncated at either extreme end of travel. This effectively prevents the cam from holding the valve spool at the far end of its travel as the piston and cam motions stop at the end of piston travel. Spool control is then controlled by the cam connected to the piston which is at mid-stroke and maximum velocity. Therefore, there is no cam position that will hold the spool in a fixed position. This will assure continued correct operation of the pumping system.

The control cam contours are determined from the flow characteristics of the proportioning valve. A given piston position will derermine the cam lift which is selected to proportion flow rhrough the valve so that piston velocity is at the correct value for the given piston position.

Different settings of the variable delivery hydraulic pump will be automatically compensated for by the cam operated spool valve system since time is not an input to the control system, only piston position.

According to the foregoing description and drawings, it is to be understood that the pumping system illustrated in FIG. 1 is capable of producing uniform discharge and suction flow rates through the use of a proportioning valve 20 controlled in response to the position of pistons 32 and 34 in Cylinders 1 and 2, respectively. The combined velocities of these two pistons remains a constant, while the proportioning valve is used to create a sinusoidal function in the piston velocities, with one piston lagging the other by 90 degrees. Proportioning valve 20 creates $\sin^2\theta$ and $\cos^2\theta$ functions in velocity, and the four-way valves are used to control the hydraulic cylinders 28 and 30 so as to translate these $\sin^2\theta$ and $\cos^2\theta$ functions into forward and reverse directions of movement of the pistons within the respective cylinders. Since the sinusoidal-shaped velocity curves present curved portions tangential to the horizontal axis at maximum positive, zero and maximum negative velocities, the piston acceleration and jerk characteristics are minimized simultaneously.

Figure 7:
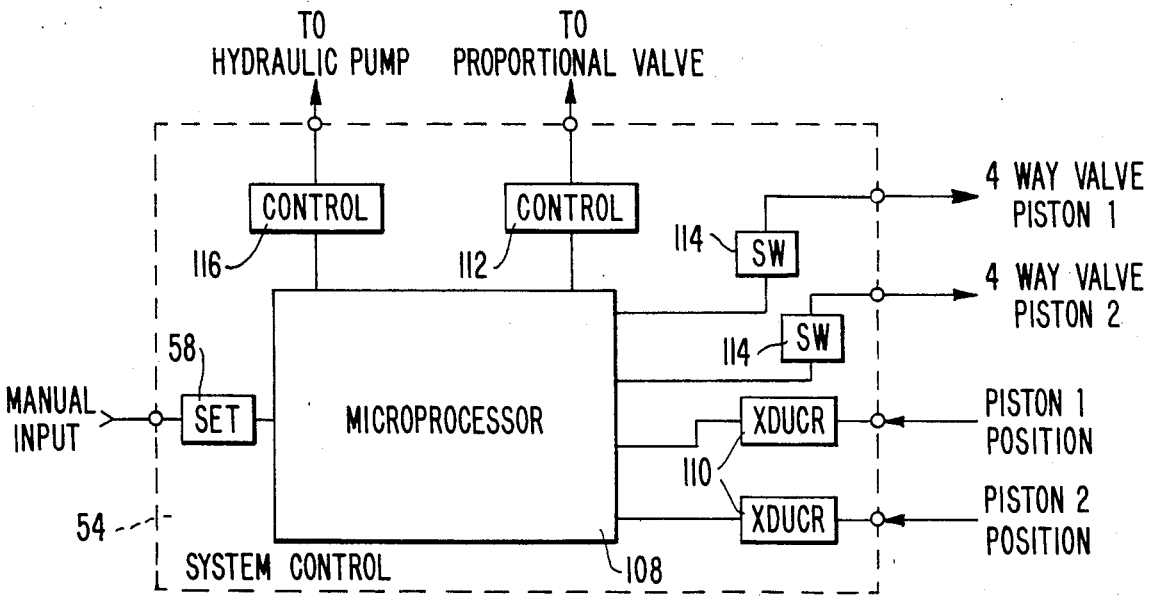
FIG. 7 is a block diagram of an alternative embodiment of the system control of the pumping system of FIG. 1.
Figure 6A:
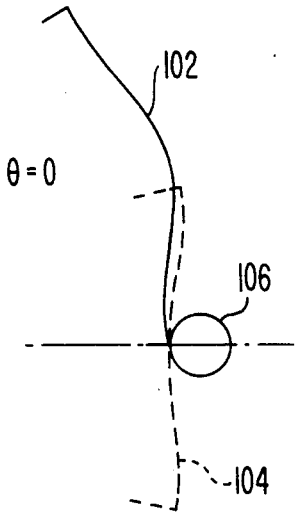
FIGS. 6a–6f show details of the system control of FIG. 5 for one-half cycle of the pumping system of FIG. 1.
Figure 6B:
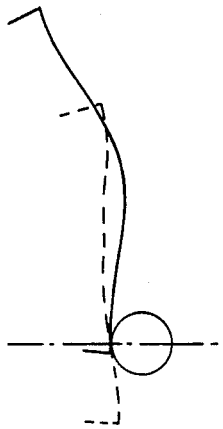
Figure 6C:
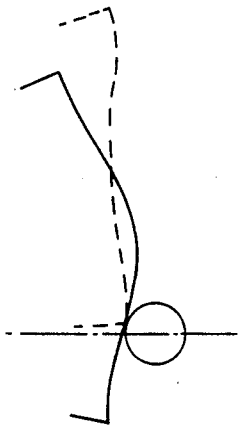
Figure 6D:
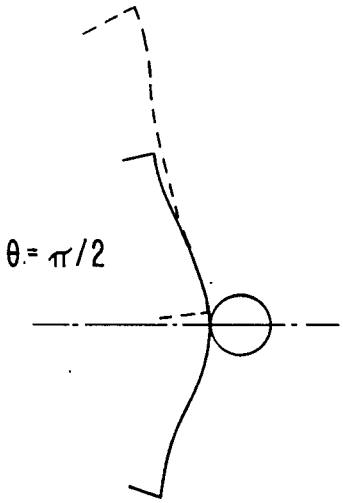
Figure 6E:
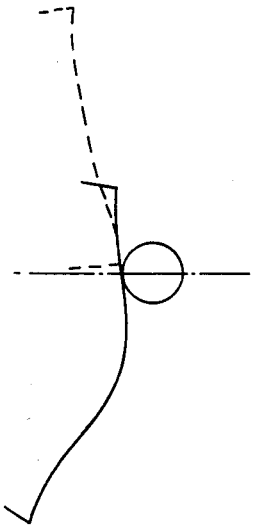
Figure 6F:
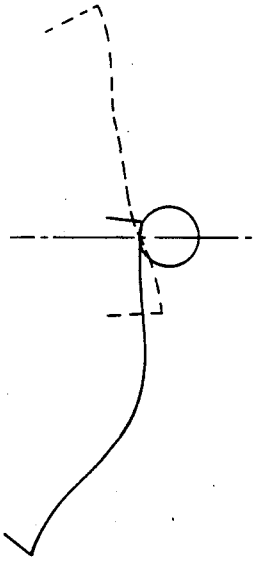

In accordance with the present invention, a second embodiment includes microprocessor means coupled to the plurality of pistons for controlling the delivering means, the selectively proportioning means and the direction-changing means. As illustrated in FIG. 7, the microprocessor 10 means may, for example, include a microprocessor 108, transducers 110 and control means 112, 114 and 116. These elements are an alternative embodiment of the system control 54 shown in FIG. 1.

Microprocessor 108 controls proportioning valve 20 and four-way valves 36 and 38 in the same manner as explained above for the mechanical embodiment. This is done in response to electrical signals delivered by a pair of transducers 110 coupled to pistons 32 and 34, respectively. Transducers 110 are connected to sense the position of the respective pistons by means of rotary optical encoders bf known types. Alternately, mechanical means such as a toothed gear or electrical means such as a variable resistor may be coupled to be driven by the pistons so that the position thereof can be detected by transducers 110. In response to the electrical signals indicative of piston position produced by transducers 110, microprocessor 108 effects control of proportioning valve 20 so as to develop the characteristics illustrated in FIG. 2 and discussed above. To adjust valve member 22 of proportioning valve 20, a control 112 is provided that is capable of translating electronic signals into mechanical action, i.e., translational movement of valve member 22. Thus, control 112 may comprise a stepper motor of a well-known type, or other known mechanisms of similar function. Microprocessor 108 also effects control of four-way valves 36 and 38 by means of control switches 114 which, like control 112, are capable of translating electronic signals into the mechanical action necessary for switching the flow of hydraulic fluid through the valves. Another electronic-to-mechanical translator 116 is provided so as to permit control of the displacement and delivery of hydraulic pump 12 by microprocessor 108. The electrical signals delivered to control means 116 may be derived from a SET input 58 of the type described hereinabove. Control 116 includes a digital-to-analog interface for controlling an electro-hydraulic displacement control in pump 12. According to this alternative embodiment, therefore, it is possible to effect highly accurate control over a pumping system in accordance with the present invention.

The position signals received from transducers 110 are processed and measured at frequent constant time periods. Piston velocities are calculated from two successive piston positions. The time period for full stroke of one piston is calculated from the sum of the piston velocities. A piston position versus time table is calculated and stored in the microprocessor memory and appropriate signals are sent to the stepper motor controlled valve to achieve and maintain this piston position versus time relationship. If the set control for varying the hydraulic pump displacement is changed, the microprocessor will calculate a new piston position versus time table and vary positions of proportioning valve accordingly.

It will be apparent to those skilled in the art that modifications and variations can be made in the pumping system method and apparatus of this invention. The invention in its broader aspects is, therefore, not limited to the 10 specific details, representative methods and apparatus, and illustrative examples shown and described. Accordingly, departure may be made from such details without departing from the spirit or scope of applicant's general inventive concept.

What is claimed is:

1. A hydraulically actuated pumping system for producing uniform discharge and suction flow rates, comprising:

means for delivering a single flow of hydraulic control fluid;

means for selectively proportioning said single flow from said delivering means into a plurality of resultant flows;

a plurality of hydraulic cylinders, each cylinder being in fluid communication with a different one of said fluid flows;

a plurality of drive pistons, each drive piston being sealably fitted in one of said hydraulic cylinders for reciprocating therein in response to respective different ones of said resultant flows;

a plurality of fluid pumping pistons connected to said drive pistons and being reciprocally operated thereby to provide fluid flow and suction; and means for controlling said selectively proportioning means in response to the position of said drive pistons to vary the relative proportions of said resultant flows to maintain the sum of the absolute values of the velocities of said drive pistons constant.

2. The pumping system according to claim 1, wherein said delivering means comprises:

a source of said hydraulic control fluid; and a hydraulic pump having an adjustable delivery flow rate, said hydraulic pump having an intake in fluid communication with said source.

3. The pumping system according to claim 1, wherein said selectively proportioning means comprises an adjustable proportioning valve, said valve including a reciprocating member for proportioning an input flow into said plurality of resultant flows.

4. The pumping system according to claim 3, wherein said adjustable proportioning valve includes:

a housing having an outer wall defining an inner bore, with an inlet passage and a plurality of outlet passages, provided in said outer wall communicating with said inner bore; and said reciprocating member being positioned coaxially with said inner bore.

5. The pumping system according to claim 1 further comprising means for complementarily changing the direction for movement of said drive pistons, said direction-changing means being in fluid communication with said selectively proportioning means and said hydraulic cylinders.

6. The pumping system according to claim 5, wherein said direction-changing means comprises:

a plurality of four-way valves, each of said four-way valves being actuatable in a predetermined relationship with respect to the reciprocating motion of a corresponding one of said plurality of drive pistons.

7. The pumping system according to claim 6 in which first and second four-way valves are provided in association with first and second drive pistons respectively to control the flow of hydraulic fluid thereto and wherein said direction-changing means further comprises:

sensing means for sensing the positions of said drive pistons; and means controlled by said sensing means for adjusting the positions of said four-way valves in response to the positions of said drive pistons such that when said first drive piston reaches the end of its stroke said first four-way valve is moved to a center blocking position to maintain a zero flow of hydraulic fluid to said first drive piston and when said second drive piston reaches a predetermined position near the center of its stroke said first four-way valve is moved to a position to reverse the flow of hydraulic fluid to said first drive piston.

8. The pumping system according to claim 7 wherein said means for adjusting the positions of said four-way valves further comprises:

means for adjusting the position of said second four-way valve such that when said second drive piston reaches the end of its stroke said second four-way valve is moved to a center blocking position to maintain a zero flow of hydraulic fluid to said second drive piston and when said first drive piston reaches a predetermined position near the center of its stroke said second four-way valve is moved to a position to reverse the flow of hydraulic fluid to said second drive piston.

9. The pumping system according to claim 1, wherein said controlling means includes:

a plurality of movable cam surfaces, each of said cam surfaces being coupled to a corresponding one of said plurality of drive pistons; and a cam follower, movable in response to said plurality of cam surfaces, being coupled to said selectively proportioning means, whereby said plurality of resulting flows are proportioned in response to movement of said cam follower.

10. The pumping system according to claim 1 wherein said drive pistons are each of a double extending type.

11. The pumping system according to claim 1 wherein the velocity of said drive pistons is held at zero for an appreciable time period when said pistons reverse directions.

12. The pumping system according to claim 11 comprising:

four-way valve means transferable between first and second states for reversing the flow of hydraulic control fluid to a first drive piston when said piston reaches the end of its stroke; and means for controlling said four-way valve means to impose thereon a period of dwell during said transfer between states, the flow of hydraulic fluid to said first drive piston being blocked during said dwell period.

13. The pump system according to claim 12 wherein said means for controlling said four-way valve means comprises:

means for initiating said dwell period when said first drive piston reaches the end of its stroke; and means for terminating said dwell period when a second drive piston reaches a predetermined point near the center of its stroke.

14. A hydraulically actuated pumping system for producing uniform discharge and suction flow rates, comprising:

means for delivering a single flow of hydraulic control fluids;

means for selectively proportioning said flow from said delivering means into a plurality of resultant flows;

a plurality of hydraulic cylinders, each cylinder being in fluid communication with said proportioning means;

a plurality of drive pistons, each drive piston being sealably fitted in one of said hydraulic cylinders for reciprocating therein in response to said resultant flows;

a plurality of fluid pumping pistons connected to said drive pistons and being reciprocally operated thereby to provide fluid flow and suction; and microprocessor means for controlling said selectively proportioning means in response to the position of said drive pistons to vary the relative proportions of said resultant flows to maintain the sum of the absolute values of the velocities of said drive pistons constant.

15. The pumping system according to claim 14, wherein said microprocessor means includes:

a plurality of transducers for sensing the position of said plurality of drive pistons and for outputting electrical signals relating to the displacement of said plurality of drive pistons; and a microprocessor connected to said plurality of transducers for controlling said selectively proportioning means in relationship to the displacements of said drive pistons.

16. The pumping system according to claim 14, wherein said delivering means comprises:

a source of saud hydraulic control fluid; and a hydraulic pump having an adjustable delivery flow rate, said hydraulic pump having an intake being in fluid communication with said source.

17. The pumping system according to claim 14, wherein said selectively proportioning means comprises an adjustable proportioning valve, said valve including a reciprocating member for proportioning an input flow into said plurality of resultant flows.

18. The pumping system according to claim 14, wherein said means for selectively proportioning said flow includes:

a housing having an outer wall defining an inner bore, with an inlet passage and a plurality of outlet passages provided in said outer wall communicating with said inner bore; and said reciprocating member being positioned coaxially with said inner bore.

19. The pumping system according to claim 14, further comprising means for complementarily changing the direction of movement of said drive pistons, said direction-changing means being in fluid communication with said selectively proportioning means and said hydraulic cylinders.

20. The pumping system according to claim 19, wherein said direction-changing means comprises:

a plurality of four-way valves, each of said four-way valves being actuatable in a predetermined relationship to reciprocating motion of a corresponding one of said plurality of drive pistons.

21. The pumping system according to claim 14, wherein said drive pistons are a double extending type.

22. The pumping system according to claim 14, wherein the velocity of said drive pistons is held at zero for an appreciable time period when said pistons reverse directions.

23. A method for providing a uniform flow rate, comprising the steps of:

delivering a single flow of hydraulic control fluid;

selectively proportioning said single flow of hydraulic control fluid into a plurality of resultant flows;

complementarily actuating a plurality of drive pistons by means of said resultant flows, each of said drive pistons being reciprocatingly fitted into a hydraulic cylinder and coupled to operate fluid pumping means to provide fluid flow; and controlling the velocity and displacement of each of said drive pistons by varying the proportional flow in said resultant flows as a function of the position of said drive pistons such that the sum of the absolute values of the velocities of said drive pistons remains constant.

24. The method according to claim 23, wherein said selectively controlling step comprises the steps of:

sensing the position of each of said drive pistons;

outputting electrical signals each related to the displacement of one of said drive pistons; and switching a plurality of four-way valves, each of said four-way valves being in fluid communication with one of said hydraulic cylinders.

* * * * *